US005239226A

United States Patent [19]

Seredich et al.

[11] Patent Number: 5,239,226

[45] Date of Patent: Aug. 24, 1993

[54] REPLACEABLE LAMP ASSEMBLY FOR AUTOMOTIVE HEADLAMPS

[75] Inventors: Douglas G. Seredich, Montville; Martin J. Graf, Wickliffe; John J. Stewart, Mentor; Brian R. Swiers, Berea, all of Ohio

[73] Assignee: General Electric Company, Schenectady, N.Y.

[21] Appl. No.: 627,518

[22] Filed: Dec. 14, 1990

[51] Int. Cl.[5] ..... H01J 5/50; H01K 1/42

[52] U.S. Cl. ..... 313/318; 313/51; 313/315; 362/226; 362/296

[58] Field of Search ..... 313/318, 113, 51, 315; 362/296, 226

[56] References Cited

U.S. PATENT DOCUMENTS

| | | | |
|---|---|---|---|
| 4,201,438 | 5/1980 | Shea | 313/318 X |
| 4,528,619 | 7/1985 | Dolan et al. | 362/61 |
| 4,719,543 | 1/1988 | Colliandris et al. | 362/226 X |
| 4,751,421 | 6/1988 | Braun et al. | 313/318 X |
| 4,769,574 | 9/1988 | Nagasawa et al. | 313/318 |
| 4,795,939 | 1/1989 | Eckhardt et al. | 313/318 |
| 4,864,183 | 9/1989 | Okano | 313/318 |
| 4,950,942 | 8/1990 | Braun et al. | 313/318 |

*Primary Examiner*—Donald J. Yusko
*Assistant Examiner*—Ashok Patel
*Attorney, Agent, or Firm*—Edward M. Corcoran; Stanley C. Corwin

[57] ABSTRACT

A replaceable lamp assembly for automotive headlamps includes an incandescent lamp having a pinch seal mounted on a plastic base by means of a one piece sheet metal holder. One end of the holder clamps around the pinch seal of the lamp and the other end is secured to the plastic base via a pair of leg portions each having a spherical gimballed end RF welded to the base.

18 Claims, 5 Drawing Sheets

Fig. 5(a)
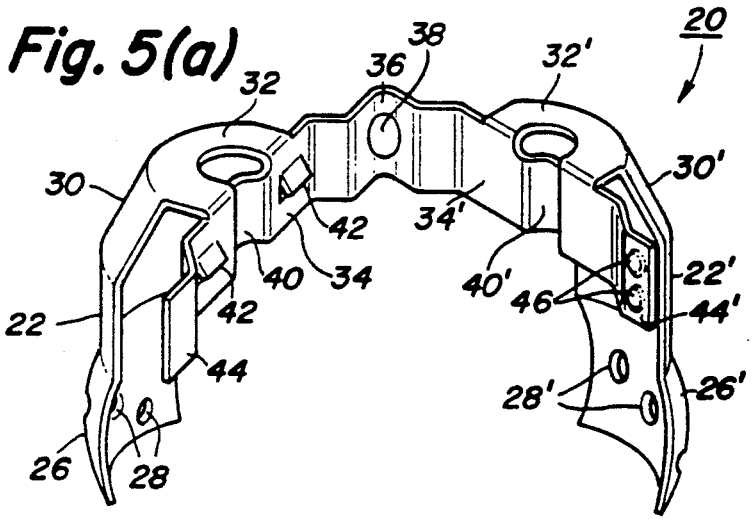
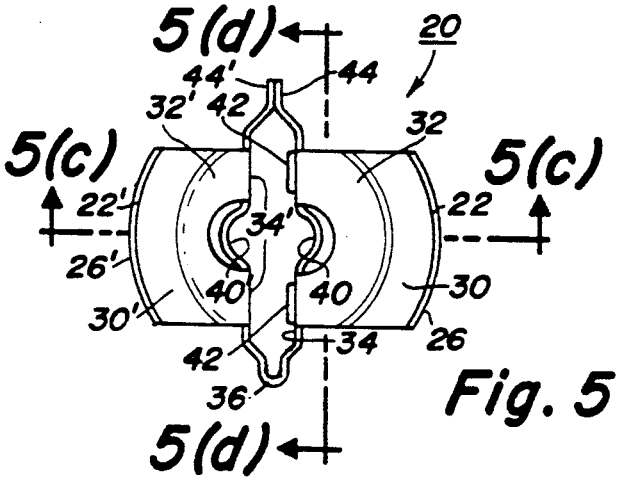
Fig. 5(b)
Fig. 5(c)
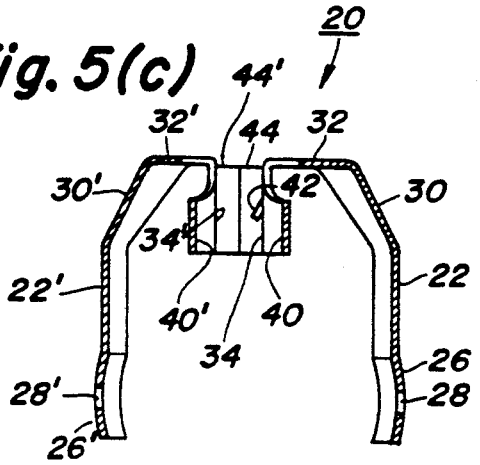
Fig. 5(d)
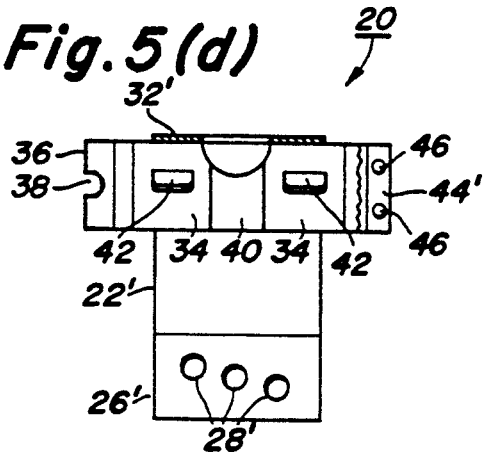

REPLACEABLE LAMP ASSEMBLY FOR AUTOMOTIVE HEADLAMPS

BACKGROUND OF THE DISCLOSURE

1. Field of the Invention

This invention relates to a replaceable lamp assembly for an automotive headlamp. More particularly, this invention relates to a replaceable lamp assembly which comprises an incandescent lamp having a flat press seal at one end mounted on a thermoplastic base by means of a holder made of a single piece of sheet metal clamped around the flattened end of the lamp and secured to the plastic base by RF welding.

2. Background of the Invention

Replaceable lamp assemblies for automotive headlamps comprising an incandescent lamp, such as an incandescent-halogen lamp, mounted on a thermoplastic base or holder body of substantially tubular shape which is mounted to a reflector in an automotive vehicle are well known to those skilled in the art. The base or holder body is precision molded from a thermoplastic material in order to achieve dimensional accuracy and low cost. The filament of the lamp must be accurately positioned with respect to the thermoplastic base so that a predetermined light distribution will result when the lamp assembly is installed in the reflector portion of an automotive vehicle. Invariably this means that if only one filament is employed, then that filament must reside at the focal center of the reflector. Where two filaments are employed in the lamp for a high beam and a low beam, one filament will generally be at the focal center of the reflector and the other filament will be offset by a certain amount in order to assure the proper light pattern emanating forward of the reflector. These replaceable lamp assemblies generally have a flange on the base portion which butts against a rearwardly protruding nose portion of the automotive lamp reflector to insure precise alignment of the assembly with respect to the reflector. Thus, the filament of the lamp must be accurately positioned with respect to the flange which fits or butts against the rear nose portion of the reflector so that a predetermined light distribution will result when the lamp assembly is installed in an automotive vehicle. Some lamps used in such assemblies are connected to a base without the use of a cement or adhesive.

Typically, such lamps comprise vitreous, light transmissive envelopes made of a high temperature glass or a high purity fused silica (quartz) which terminates at the bottom end in a pinch or press seal. An exhaust tip through which the interior of the lamp envelope is exhausted and a fill gas introduced may be present at either the top or bottom end of the lamp envelope as is well known to those skilled in the art. Electric current supply leads extend outwardly of the press seal and at least one incandescent filament is located interiorly of the lamp envelope electrically connected to the current supply leads. One end of a sheet metal lamp holder clamps around the flat pinch or press seal of the lamp and is coupled at its other end to the plastic base. The plastic base is generally cylindrical in shape having two internal cavities, each open at one end with a wall separating the two cavities through which connecting terminals for the lamp extend which are electrically connected to the lamp current supply leads at one end and to a male electric plug at the other end. Such replaceable automotive lamp assemblies presently available employ at least two or three metal parts to form a lamp holder unit for connecting or coupling the incandescent lamp to the plastic base. Such multiple part construction requires multiple assembly steps and parts. Typical prior lamp assemblies are disclosed, for example, in U.S. Pat. Nos. 4,719,543; 4,950,942; 4,864,183; 4,769,574, 4,751,421 and 4,528,619.

Construction of a typical replaceable automotive lamp assembly presently available and used is illustrated in perspective view in FIG. 1. Thus, lamp 100 is secured into thermoplastic base 102 by means of lamp holder 104. Flange 106 serves to accurately position the lamp assembly into an automotive reflector by acting as a stop when inserting the assembly into the rear of the reflector. O-ring 108 is made of a heat resistant elastomeric material, such as a silicone rubber, and serves to provide a hermetic seal of the lamp assembly into the reflector. A resinous, heat resistant potting compound (such as a silicone) is applied inside the bottom cavity adjacent the wall separating both cavities of the base to hermetically seal the electrical terminals molded into the wall. Plug 110, which is not a part of the lamp assembly, plugs into the bottom cavity where it contacts terminals for wires 112 to make electrical connection to the lamp. Turning to FIG. 2, lamp holder 104 is shown in more detail in perspective view and lamp 100 is shown in partial phantom view merely to illustrate lamp filaments 114 and 116. Thus, lamp holder 104 comprises a metal clamp 118 which is clamped around the flattened pinch seal base or bottom portion (not generally shown) of lamp 100 as an assembly of two rectangular sheet metal straps 123 and 124 which are clamped around the flattened lamp end portion, bent and welded together at 120 and 122. Clamp 118, in turn, is secured to metal cup 130 by means of welding, of which only welds 126 and 128 are shown for metal strap 124. Metal cup 130, in turn, is secured to metal sleeve 105 by means of welding (i.e., 136 and 137) to four strap portions of which only two, 132 and 134 are shown. Wire connectors 140, 142 and 144 extend downwardly from lamp 100 to make electrical connection with respective terminals in base 102. To couple lamp 100 to plastic base 102, lamp 100 is mechanically secured by means of welding clamp 118 around the pinch seal of the lamp which, in turn, is welded to metal cup 130. Metal sleeve 104, being made of sheet steel, is secured to the interior walls of the upper cavity in plastic base 102 by adhesive or RF welding. The preassembled lamp 100, clamp 118 and cup 130 are then positioned within and adjacent the strap portions of sleeve 104 as shown and wires 140, 142 and 144 are soldered to respective terminals in base 102. The position of the lamp, clamp and cup subassembly is then adjusted while at least one filament is energized in order to accurately position the filament radially with respect to the longitudinal central axis of the replaceable lamp assembly and also with respect to its distance from flange 106. Once the filament has been accurately positioned, cup 130 is welded to the strap portions of sleeve 104 in order to secure the lamp to the base.

Accordingly, it would be a significant advance to the art if one could reduce the number of parts, manufacturing steps and concomitant costs in the manufacture and assembly of such replaceable automotive lamp assemblies.

SUMMARY OF THE INVENTION

The present invention relates to a replaceable lamp assembly for automotive headlamps which employs an incandescent lamp having a pinch seal or flattened portion at one end, wherein a one piece sheet metal lamp holder is employed to mount or couple the lamp to a thermoplastic base. The lamp holder comprises two opposing halves joined by a hinge means, each half having a clamp means and a leg means. The clamp means is located adjacent the top of each half and comprises a substantially rectangular shaped metal strap. When the holder is closed around the pinch seal of the lamp in clamshell fashion, the clamp means of both halves cooperate to clamp around the flat pinch or press seal portion of the lamp and are then welded together to mechanically secure the lamp in the holder. Two leg portions of each half extend outwardly and downwardly from the top of the holder in a taper or conical fashion and terminate in a spherical gimbal area which is secured to the plastic base. The spherical portion of the metal lamp holder is preferably secured to the plastic base by means of high frequency or radio frequency (RF) welding. Thus, the metal lamp holder is preferably made of a ferromagnetic material, such as sheet steel. After the lamp has been secured to the lamp holder, the bottom spherical shaped portion of the lamp holder is inserted into a cavity in the plastic base wherein it contacts the interior wall portion of the cavity, the lamp filament is aligned, and an RF coil is placed adjacent each leg and energized to heat each leg sufficient to cause the thermoplastic adjacent the spherical portion to melt, thereby securing the lamp and lamp holder subassembly to the plastic base.

Thus, the present invention relates to a replaceable lamp assembly for automotive headlamps which comprises an incandescent lamp, one end of which is flattened by a pinch seal, wherein said lamp is secured to a plastic base by means of a one piece sheet metal lamp holder comprising two halves joined by a hinge means with each half having a clamping means at one end which clamps around the pinch seal of said lamp to mechanically secure said lamp to said holder and the other end of each half terminating in a spherical gimbal area which is secured to said base. In a a still further embodiment of the invention, the metal terminal pins of the base are integrally molded into the plastic in a hermetic fashion, which avoids the need for applying a hermetic sealing compound to the base.

BRIEF DESCRIPTION OF THE DRAWINGS

FIG. 5 illustrates perspective and schematic views of the one piece sheet metal lamp holder of the invention.

DETAILED DESCRIPTION

Figure 2:
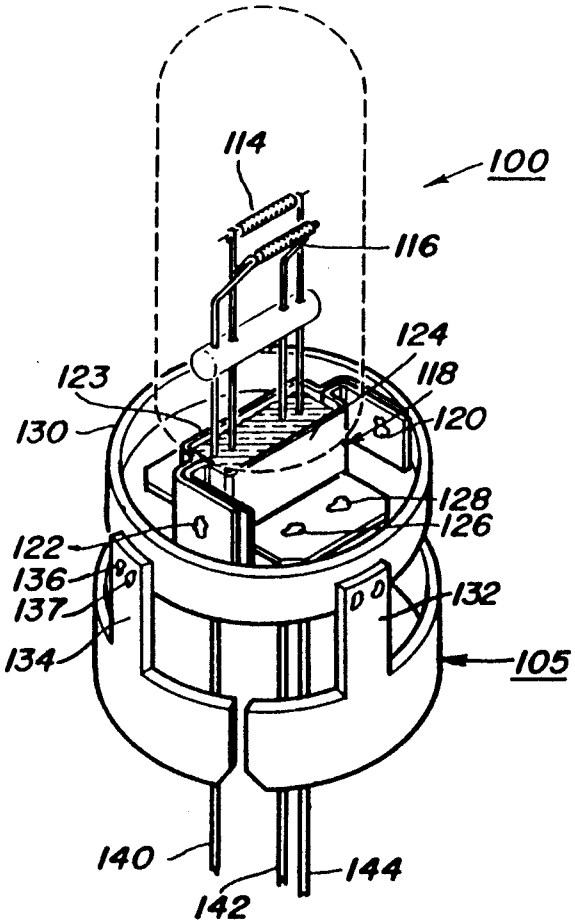
Fig. 2 (PRIOR ART)
FIG. 2 is a perspective view of the three piece, sheet metal lamp holder employed in the replaceable lamp assembly of FIG. 1.
Figure 1:
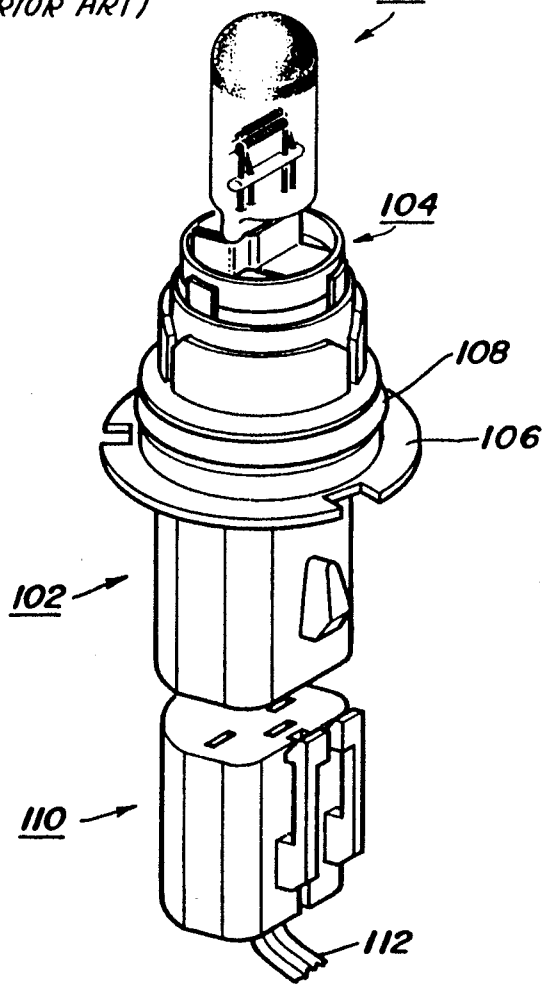
Fig. 1 (PRIOR ART)
FIG. 1 is a perspective view of a prior art replaceable lamp assembly for an automotive headlamp, including an electrical connecting plug.
Figure 3:
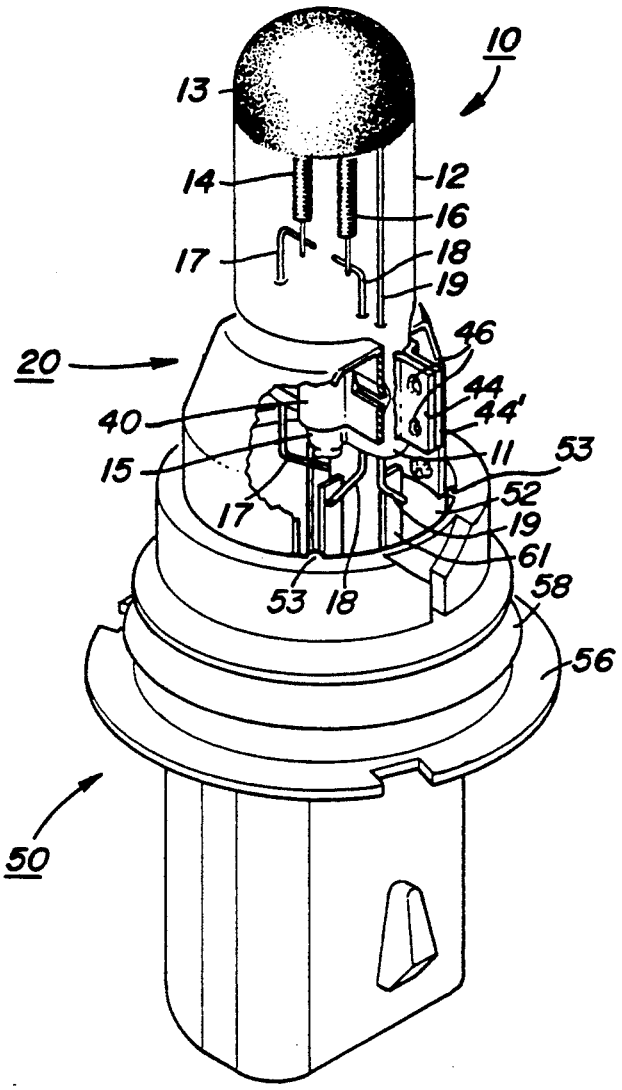
FIG. 3 is a perspective view, in partial cut-away fashion, of a replaceable automotive lamp assembly of the present invention.
Figure 4:
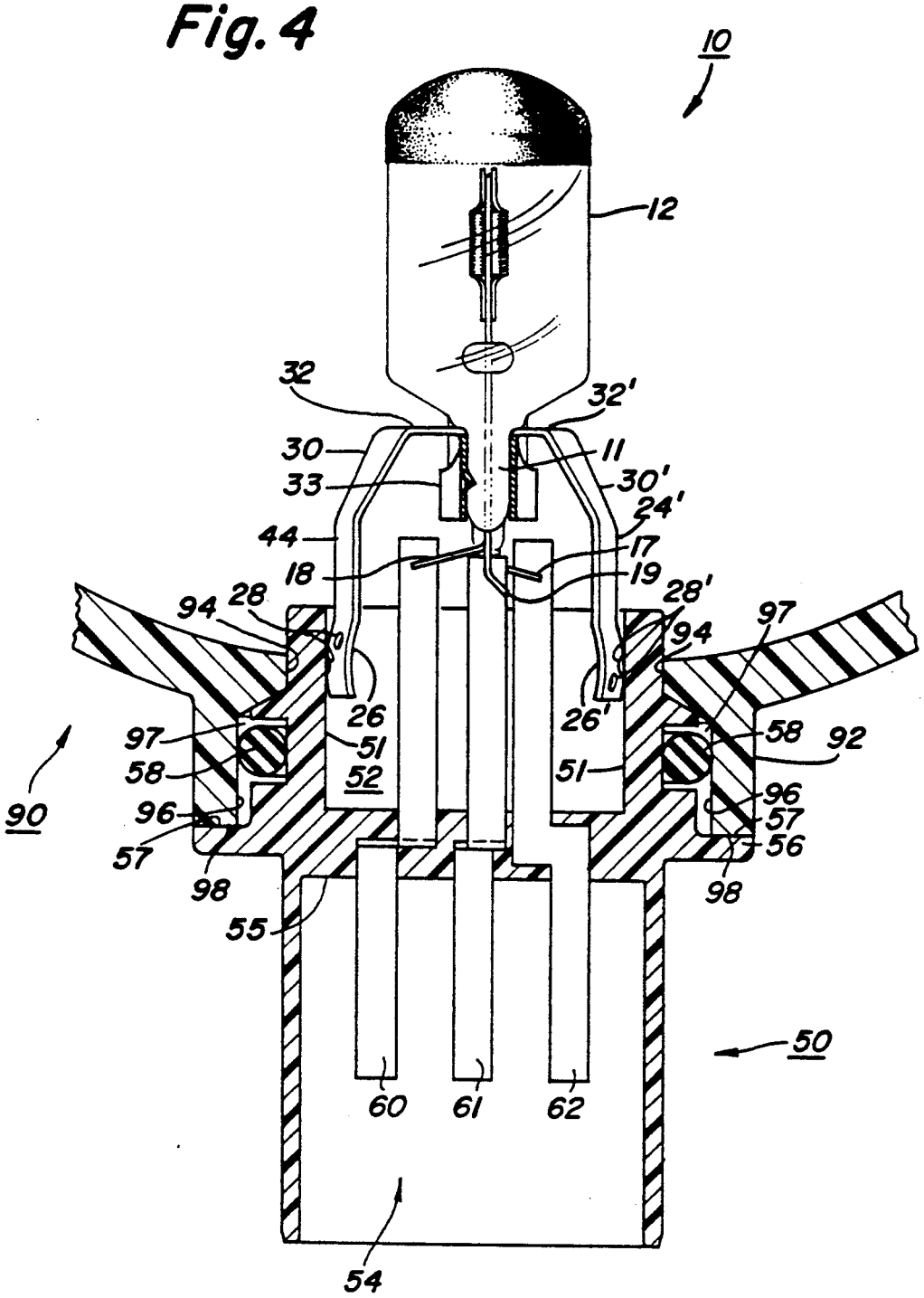
FIG. 4 is a schematic view of a replaceable automotive lamp assembly of the present invention shown inserted into the rear portion of a automotive reflector.

FIG. 3 is a perspective view, in partial cut-away form, of a replaceable lamp assembly of the present invention. Turning to FIG. 3, incandescent-halogen lamp 10 is shown clamped in metal lamp holder 20, a portion of which extends into and is secured in cavity 52 of plastic base 50. In this embodiment, four ribs 53 are molded into the interior surface of cavity 52 extending longitudinally therein of which only two are shown. These ribs aid in positioning the lamp/holder subassembly in the cavity prior to lamp alignment. Sufficient clearance is provided between the locating ribs and lamp holder 20 to allow the necessary amount of radial alignment of the lamp filament before securing the lamp/holder subassembly to the inside envelope of cavity 52. Lamp 10 is an incandescent-halogen lamp which comprises a vitreous outer envelope 12 enclosing within a pair of tungsten filaments 14 and 16 for high and low beam supported by molybdenum lead wires 17, 18 and 19 which pass through the hermetic press seal 11 at the bottom of the lamp where they are connected to one end of terminal pins 60, 61 and 62. Envelope 12 also contains an inert gas, a getter such as phosphorus, hydrogen and at least one halogen within as is well known to those skilled in the art. Light opaque coating 13 on top of lamp 10 insures that all of the visible light emitted is projected forward by the reflector into which the assembly is inserted. Coating 13 is typically a black, heat resistant coating. The lamp is filled and exhausted through a fill-exhaust tube 15 which passes through pinch seal 11 and is tipped off and sealed. Alternatively, the lamp envelope could be filled and exhausted through the top of the lamp as is well known to those skilled in the art. Base 50 is similar to the prior art base 102 shown in FIG. 1. Thus, base 50 contains flange portion 56 and silicone rubber O-ring 58. In use, the replaceable lamp assembly is inserted into the rear of a plastic automotive headlamp reflector 90 as shown in FIG. 4, with flange 56 serving to position lamp 10 within the reflector at the proper focal point. O-ring 58 serves to hermetically seal the replaceable lamp assembly in the rearwardly protruding nose portion 92 of plastic automotive reflector 90. After the lamp assembly has been inserted into and locked in the automotive reflector, an electrical connecting plug similar to plug 110 shown in FIG. 1 is inserted into cavity 54 of base 50 in order to make electrical connection with the lamp via terminal pins 60, 61 and 62.

FIG. 4 illustrates an embodiment of the invention as an axial sect ion through the lamp assembly of FIG. 3, shown inserted into an automotive reflector. Turning to FIG. 4, lamp 10 is mechanically shown secured into metal lamp holder 20 by means of rectangular clamping section 33 which is clamped around the flattened, press seal portion 11 of the lamp and welded at one end (see 46 in FIG. 3). Identical and opposing leg members 22 and 22' are shown secured to the inside wall 51 of bore 52 of plastic base 50 at the spherilized gimbal sections 26 and 26', respectively. Lamp outer leads 17, 18 and 19 are shown bent and welded to one end of terminal pins 60, 61 and 62, respectively, which are molded into and pass through wall 55 of base 50. The other end of pins 60, 61 and 62 are located inside lower bore 54 of base 50 for connection to a suitable plug such as is shown in FIG. 1 as 110. If desired or necessary, a heat resistant potting compound, such as a silicone, can be applied to one surface of wall 55 to provide a hermetic seal around the terminal pins. Lamp holder 20 is secured to the inside surface 51 of cavity 52 by RF heating legs 22 and 22', which causes the thermoplastic to melt and, in a preferred embodiment, at least partially exude through holes 28 and 28' (FIG. 5) in spherical portions 26 and 26' of legs 22 and 22' which contact the inside surface or wall 51 of bore 52. Plastic base 50 is preferably fabricated from a heat and impact resistant thermoplastic, (e.g., polyphenylene imide) suitable for use in the relatively harsh environments associated with automotive headlamps. One suitable thermoplastic material is "Ultem" available from GE Plastics, Burlington, Mass. Another suitable thermoplastic material commercially available is "Ryton R4" available from the Philips Petroleum Company, Pasadena, Texas. O-ring 58 serves to make a hermetic seal between base 50 and the interior surface 96 in cavity 97 in nose portion 92 of automotive reflector 90 into which base 50 is inserted and secured. O-ring 58 is preferably made of a heat-resistant elastomeric or rubbery material, such as a silicone rubber. The upper surface 57 of base flange 56 butts up against outer surface 98 of nose portion 92 of reflector 90, with the upper portion of base 50 passing through a circular cavity defined by surface 94 of reflector 90. Sheet metal lamp holder 20 is flat at the top (32, 32'). Each of leg members 22 and 22' depend from 32 and 32' and taper downwardly and outwardly as cone sections 30 and 30' and then downwardly as straight portions 24 and 24' which are radiused to have a radius of curvature approximating that of bore 52. This cone-shaped type of construction minimizes blocking the light emitted from the lower portion of the lamp from reaching the reflector. Straight sections 24 and 24' terminate in spherical gimbal areas 26 and 26' having holes 28 and 28', respectively.

FIG. 5 illustrates metal lamp holder 20 in greater detail. Turning to FIG. 5(*a*), the unitary structure of sheet metal lamp holder 20 is shown as comprising two similar and opposing side strap or leg portions 22 and 22' of a generally shell shape each terminating at one end in spherilized gimbal portions or sections 26 and 26' having holes 28 and 28' which assist in securing the holder to the inside surface 51 of bore 52 of the plastic base 50. The radius of curvature of 26 and 26' is essentially that of the inside radius of cavity 52 of base 50. The upper portion 30 and 30' of legs 22 and 22' is in the general shape of a frustum terminating at the top portion thereof in flat, generally semicircular sections 32 and 32' from which in turn depend rectangular clamping straps 34 and 34'. Both halves of holder 20 are joined together at hinge 36 and cooperate to close in clamshell fashion. Hole 38 is preferably cut out of hinge 36 in order to reduce the force required to clamp rectangular straps 34 and 34' around the flat press seal end portion of the lamp and also to reduce the tensile stress exerted on the final assembly. Strap members 34 and 34' together form clamp means 33 which mechanically holds the lamp secure in the assembled lamp holder. In one embodiment wherein lamp 10 has an exhaust tube portion sealed into the pinch seal, clamping straps 34 and 34' will each have a semicircular or radiused section 40 and 40,' to accommodate the exhaust tube protrusion in the seal without breaking it. Partially stamped out tabs 42, which cooperate with recesses 11 and 11' (FIG. 6) molded in the pinch seal, assist in firmly securing the lamp in the holder. After being clamped around the lamp pinch seal, straps 34 and 34' are welded together at their respective free ends at weld tabs 44 and 44', respectively. Weld dimples 46 insure positive welding of tabs 44 and 44' to each other.

Figure 6:
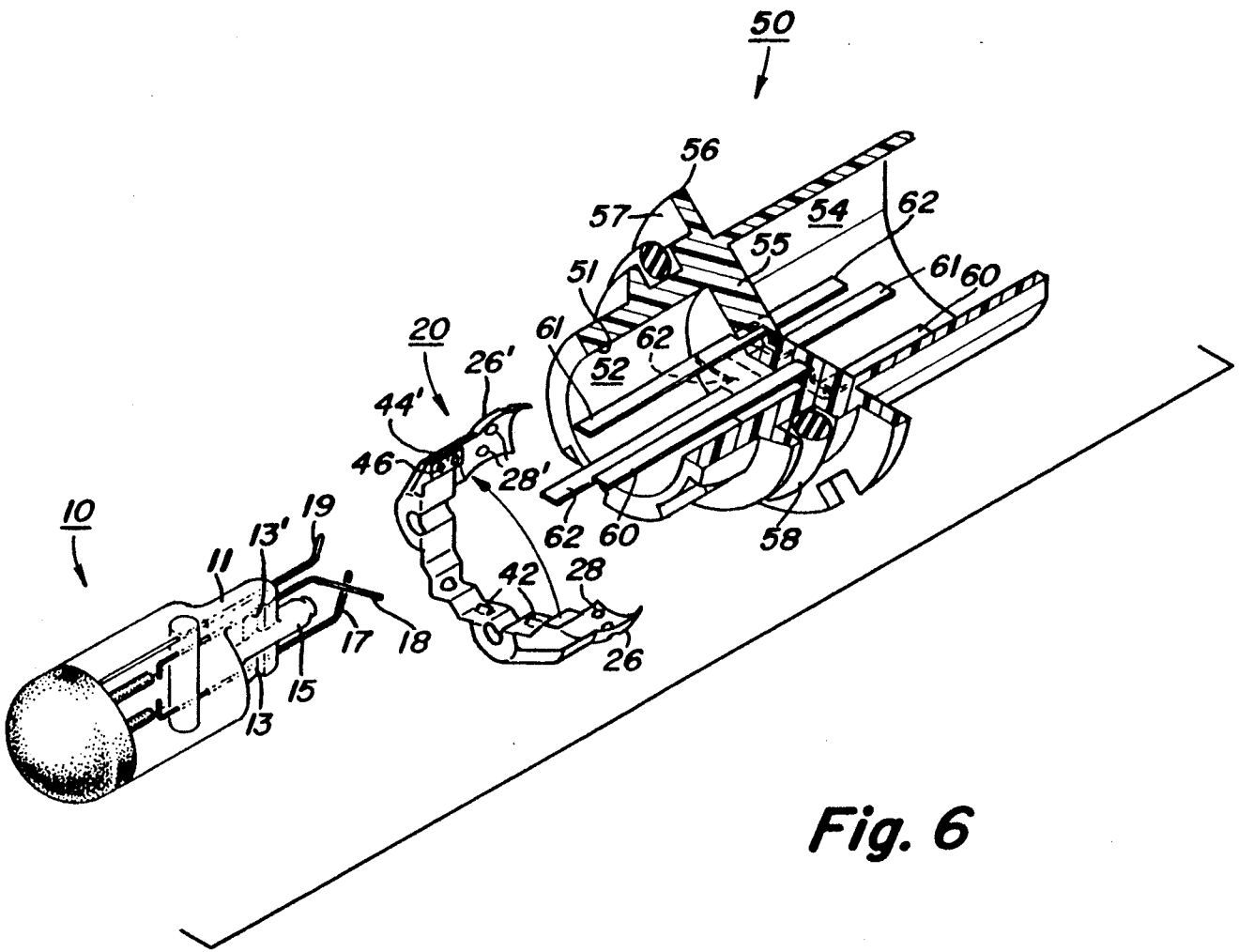
FIG. 6 is an exploded perspective view of the lamp assembly of the present invention.

An exploded perspective view of a replaceable automotive lamp assembly according to the present invention is shown in FIG. 6. In assembling the various parts, terminals 60, 61 and 62 are integrally molded into wall portion 55 of base 50. Holder 20 is clamped, via rectangular clamp straps 34 and 34', around the flattened, pinch seal bottom portion 11 of lamp 10 and straps 34 and 34' welded together at the weld tabs. The lamp-/holder subassembly is then inserted into cavity 52 of holder 50 and held in place in said cavity while outer leads 17, 18 and 19 are electrically connected to a respective one of terminals 60, 61 and 62. The lamp filament is then energized and the position of the lamp-/holder subassembly is adjusted to insure that the lamp filaments are properly aligned both radially and with respect to the required distance from the upper surface 57 of locating flange 56 of base 50. The distance between spherical sections 26 and 26' is greater than the inside diameter of cavity 52 to insure contact of these spherical sections with the interior of thermoplastic wall surface 51. These spherical sections, 26 and 26' act as gimbals to permit three dimensional movement of the lamp/holder subassembly within cavity 52 as the lamp filament is being aligned. After the filament is aligned, each of metal leg members 22 and 22' is then heated by means of an RF coil which causes a portion of the plastic wall 51 inside cavity 52 in contact with spherical sections 26 and 26' to melt. On cooling, the plastic adheres to the metal, thereby securing the holder to the base. Preferably at least some plastic flows at least partially into or through holes 28 and 28' which provides a stronger bond to the metal. The lamp leads are then welded to their respective pins and the assembly is complete.

What is claimed is:

1. A one piece ferromagnetic metal holder for connecting a lamp to a lamp base, said holder comprising two opposing and cooperating halves joined by a hinge means, each half comprising a clamp means and a leg means terminating in a gimballed, spherilized section depending from said clamp means for connection to said base, said clamp means of each said half cooperating to mechanically secure said lamp in said holder when said halves are pressed or folded together in clamshell fashion.

2. The holder of claim 1 wherein each said half terminates in one leg means.

3. A one piece ferromagnetic metal holder for connecting a lamp having a flat portion to a lamp base, said holder comprising two opposing and cooperating halves joined by a hinge means, each half including a clamp means and a leg means depending from said clamp means for connection to said base, said clamp means of each said half cooperating to mechanically secure said flat portion of said lamp in said holder when said halves are pressed or folded together in clamshell fashion to secure said lamp in said holder and said leg means each terminating in a gimballed, spherilized section.

4. The holder of claim 3 wherein said clamp means is substantially rectangular in shape.

5. The holder of claim 4 wherein said clamp means of said halves are connected at one end by said hinge means.

6. The holder of claim 5 wherein at least one of said clamp means possesses at least one tab which cooperates with a corresponding recess in a lamp.

7. A replaceable lamp assembly for an automotive headlamp comprising:

(i) an electric lamp;

(ii) a plastic base having a cavity;

(iii) means for supplying current to said lamp, and (iv) a one piece metal lamp holder which couples said lamp to said base, said holder comprising two opposing and cooperating halves joined by a hinge means, each half having a clamp means and a leg means depending from said clamp means, said leg means terminating in a spherical, gimballed portion which is connected to an inside surface of said base cavity and said clamp means of said each half being clamped around said lamp thereby mechanically securing said lamp in said holder.

8. The assembly of claim 7 wherein said holder is made of ferromagnetic metal and is secured to said wall by RF welding.

9. The holder of claim 8 wherein said clamp means of said halves are connected at one end by said hinge means.

10. The assembly of claim 9 wherein said cavity contains rib members for proximately locating said holder in said cavity.

11. The assembly of claim 10 wherein said lamp is an incandescent-halogen lamp.

12. A replaceable lamp assembly for an automotive headlamp comprising:

(i) an incandescent lamp comprising a vitreous envelope enclosing within at least one filament and at least two electrically conductive leads connected to said filament, with one end of said envelope terminating in a flat portion and with said conductive leads passing through said flat portion outside said envelope for making electrical connection to a source of electricity;

(ii) a plastic base having a cavity within for receiving at least a portion of one end of a one piece metal lamp holder;

(iii) means for supplying current to said lamp, and (iv) a one piece ferromagnetic metal holder for coupling said lamp to said base, said holder comprising two opposing and cooperating halves joined by a hinge means, each said half including a clamp means and a leg means depending from said clamp means, said leg means terminating in a spherical, gimballed portion, said clamp means of each half being clamped around said flat portion of said lamp and cooperating to mechanically secure said lamp in said holder.

13. The assembly of claim 12 wherein said holder is made of ferromagnetic metal and is connected to said inside plastic base wall by means of RF welding.

14. The assembly of claim 13 wherein said clamp means is substantially rectangular in shape.

15. The assembly of claim 14 wherein said clamp means of said halves are connected at one end by said hinge means.

16. The assembly of claim 15 wherein said plastic base contains metal electrical terminal pins hermetically molded into said base for supplying current from a source outside said assembly to said lamp.

17. In combination, an automotive headlamp comprising a light reflecting portion containing a replaceable lamp assembly, said lamp assembly comprising:

(i) an electric lamp;

(ii) a plastic base, (iii) means for supplying current to said lamp, and (iv) a one piece ferromagnetic metal lamp holder which couples said lamp to said base, said holder comprising two opposing and cooperating halves joined by a hinge means, each half having a clamp means and a leg means depending from said clamp means, said leg means terminating in a portion which has a spherilized surface which is connected to said base by RF welding, said clamp means of each said half being clamped around said lamp and thereby mechanically securing said lamp in said holder.

18. The combination of claim 17 wherein said clamp means is secured around a flat portion of said lamp.

* * * * *